United States Patent [19]

Intengan

[11] 4,177,845

[45] Dec. 11, 1979

[54] RACQUET DISPLAY CASE

[76] Inventor: Franklin S. Intengan, 66 W. 81st. St. Apt. W-122, Hialeah, Fla. 33014

[21] Appl. No.: 894,036

[22] Filed: Apr. 6, 1978

Related U.S. Application Data

[63] Continuation-in-part of Ser. No. 851,143, Nov. 14, 1977, abandoned.

[51] Int. Cl.[2] ..... A45C 11/00

[52] U.S. Cl. ..... 150/52 G; 206/315 R; 190/52; 224/45 R

[58] Field of Search ..... 150/52 G; 206/315 R, 206/315 B; 190/52; 273/74; 224/45 R

[56] References Cited

U.S. PATENT DOCUMENTS

| | | | |
|---|---|---|---|
| 298,125 | 5/1884 | Shepard | 273/74 |
| 1,541,895 | 6/1925 | Blair | 273/74 |
| 1,620,072 | 3/1927 | Chase | 150/52 G |
| 3,963,103 | 6/1976 | Cowen | 190/52 |
| 4,063,581 | 12/1977 | Williams | 150/52 G |

FOREIGN PATENT DOCUMENTS

| | | | |
|---|---|---|---|
| 1565476 | 3/1969 | France | 206/315 B |

*Primary Examiner*—Donald F. Norton

[57] ABSTRACT

A racquet display case for carrying, displaying and storing a racquet of predetermined overall length, the racquet having a handle of a predetermined cross sectional area and a head of a predetermined thickness and span. The case has a rigid frame defining a center opening, the preferred embodiment of the rigid frame includes a generally parallel upper and lower run of a length substantially equal to but slightly greater than that of the overall length of the racquet, and a first and second generally parallel end run extending between the upper and lower runs. The upper and lower runs are spaced from one another a distance substantially equal to but slightly greater than the span of the head end of the racquet. The frame includes means for holding the racquet in confining relation to the center opening. Compartment structure with an access opening are included on the frame and extend along the racquet handle.

15 Claims, 5 Drawing Figures

RACQUET DISPLAY CASE

This application is a continuation-in-part of my copending patent application Ser. No. 851,143 filed Nov. 14, 1977 for a Tennis Racket Case now abandoned.

FIELD OF THE INVENTION

This invention relates to a relatively thin racquet carrying and racquet display structure or case which includes a frame loop which is of optimum size in that it makes maximum use of space within which a racquet is to be protectively housed and displayed when not in use and which peripherally bounds three separate zones, a first main zone wherein a racquet is protectively located and secured and a pair of elongate auxiliary compartment zones, one on each side of the racquet handle and generally parallel to it and which compartment zones are each provided with compartment structure; and the compartment structure first main zone and frame are all characterized by a common plane of symmetry.

THE INVENTION GENERALLY

In the past, there have been numerous types of receptacles, some of which have been especially designed for carrying racquets. Many of these have been in the form of a racquet head pocket into which the head of a racquet is positioned and clamped or captivated with the handle extending from it. Others have been of the suitcase type, i.e., two hingedly connected mating half cases or half receptacles which open along a hinge line like a clam to gain common access to a receptacle interior separated by septums into a main area to receive a racquet and other subsidiary areas clustered about the main area to receive tennis balls or other paraphernalia. This invention is of an improved racquet carrying display and storage frame or case which is not composed of hingedly connected parts or of a pocket into which the head of the racquet is adapted to be thrust, but, rather, is in the form of a ring sized to bound the outline of the main plane of the racquet head and within which ring the racquet is adapted to be protectively held and displayed and which device is further provided with separate, independent, parallel, elongate compartment structure aligned on opposite sides of the handle of the racquet and bounded by the ring, and wherein the ring and compartment structure are characterized by a common main plane of symmetry which is, generally speaking, common to a racquet when protectively housed and displayed within the frame.

The shape of the minimum amount of space which is ordinarily occupied by a racquet is, generally speaking, clumsy because the racquet is usually rounded at one end and includes a central, elongate handle or stem extending from the head. In short, a racquet stored separately without a receptacle for it cannot readily be aligned vertically or horizontally and, most often, it is stored with its longitudinal centerline at a tilt angle. The concept of the present invention is the provision of a racquet carrying case of minimum size which provides a generally horizontally aligned protective shield and wherein the racquet is displayed in a horizontal attitude for carrying it or storing it. The carrying case utilizes spaces on opposite sides of the handle of the racquet and between the racquet handle and the ring to provide auxiliary compartment structure connected to the ring or frame. Generally, the invention is of a relatively thin racquet case which is not substantially longer than the overall length of a racquet and not substantially wider than the netted end of the tennis racquet and not substantially thicker than the racquet handle except for the auxiliary compartments so that minimum space is required to protectively house a racquet and in which the racquet is displayed. The device is adapted to receive two racquets in parallel, side-by-side relation on opposite sides of a common plane of symmetry in an alternative embodiment described hereinafter.

REPRESENTATIVE PRIOR ART

In the past there have been numerous types of racquet cases. For example, U.S. Pat. No. 298,125 is of a case for lawn tennis implements which comprises a single compartment where everything is housed together in contrast to the instant invention where there are three independent and compactly arranged compartments which are arranged in spaced relation with respect to one another by a circumscribing frame or skeletal ring. U.S. Pat. No. 1,027,786 is for a racquet case and press wherein a single compartment system for a tennis racquet is provided without regard to the provision of space for balls and other tennis equipment; and, moreover, this prior art device is for a racquet case with a built-in press. U.S. Pat. No. 1,541,895 is of a container for a tennis racquet; however, the utilization of space and the compact arrangement of the compartments is not as set forth and claimed in this invention. The travel kit and game of U.S. Pat. No. 3,990,573 is of an executive travel kit utilizing a single enclosure system primarily intended for a golf putting arrangement and briefcase. Also, U.S. Pat. No. 4,023,800 is of a pair of side members hingedly connected together and not of an independent compartment system compactly arranged in accordance with the geometrical configuration as is more fully set forth hereinafter.

An additional U.S. patent in the art is U.S. Pat. No. 3,963,103 which provides structure to jacket the head of a racquet only with the handle extending from the racquet head jacketing structure and not protectively housed within a frame in a displayed condition. There is also a French Pat. No. 1,565,476, which is of a suitcase type structure, i.e., opens like an oyster shell about a hinge, to provide common access to a plurality of open compartment structure defined by septums and a racquet press.

It will be seen that the instant invention differs from that of the prior art in that it provides a frame loop or frame ring defining a main plane of symmetry and within which the racquet is adapted to be secured generally symmetrically with respect to the plane of symmetry so as to be protectively housed within the ring which includes means to connect to the periphery of the racquet and to the ring wherein the racquet handle extends along a line longitudinally generally coincident with the longitudinal centerline of the ring, and wherein separate, independent, elongate compartment structure is provided, one on each side of the handle and within the frame boundary; and wherein the compartment structures are symmetrical with respect to the plane of symmetry through the frame and racquet so that no hinges are required to gain access to the racquet reducing the number of parts required and protectively housing the racquet within the frame so that it is adapted to be displayed while in a protected condition.

OBJECTS OF THE INVENTION

It is an object of this invention to provide a carrying and display case for a racquet or other equipment, such as tennis balls, which is of an optimized geometric configuration, the main dimensions of which are dictated by the outline of the racquet. In other words, a relatively thin racquet case in the form of a frame ring is provided which is of an overall length, overall height, and overall thickness which is dictated by the dimensions of a standard racquet in that (a) the overall case length is slightly larger than the overall length of a standard racquet, (b) the overall case height is slightly larger than the span across the face of the head of the racquet; and (c) the case thickness is slightly larger than that of the racquet handle. On the case longitudinally extending pouches or compartment structure are provided on opposite sides of the handle zone and between the handle zone and the frame ring. These are somewhat larger than the handle thickness projecting outwardly slightly but in symmetrical relation with respect to a longitudinally extending center plane through the case. Structure is also provided on the frame ring to hold the racquet protectively within the ring.

It is another object of this invention to provide a racquet case characterized by an outer ring defining the thin case frame and wherein the ring is spanned by the faces of the racquet and wherein a first elongate upper compartment and a second elongate lower compartment are provided on opposite sides of the zone of the case which receives the racquet handle.

Generally speaking, it will be apparent from the following description that it is an overall object of this invention to provide an improved, inexpensive and convenient to use racquet carrying case which may be utilized for carrying not only the racquet, but associated equipment, such as balls and for storing the same in a compact condition in a relatively small apartment and closets when not in use and in which the racquet is adapted to be displayed as will be appreciated by those familiar with the decorative designs of relatively expensive tennis racquets.

In accordance with these and other objects which will become apparent hereinafter, the instant invention will now be described with reference to the accompanying drawings in which:

DESCRIPTION OF PREFERRED EMBODIMENT

Figure 1:
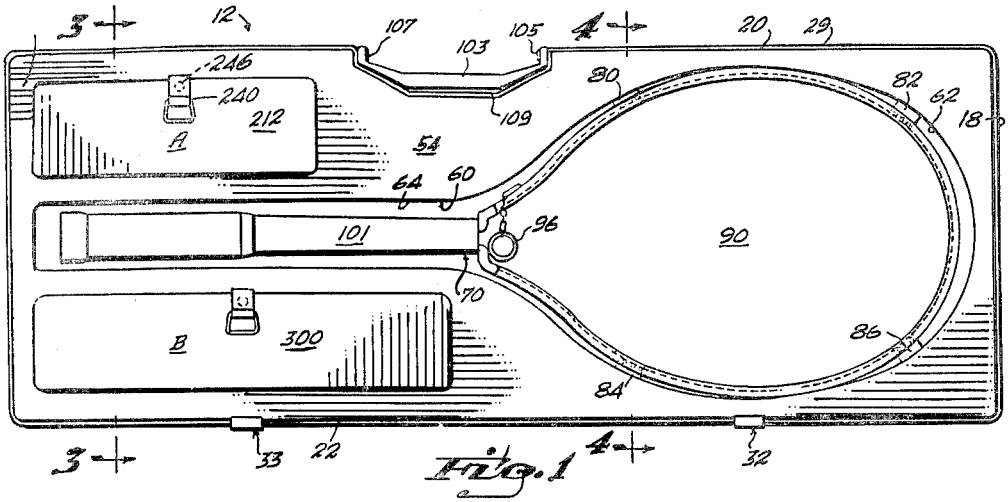
FIG. 1 is a side elevation view of the instant invention.
Figure 2:
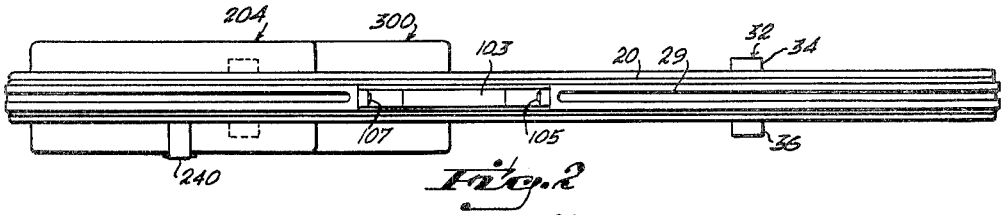
FIG. 2 is a top plan view of the device shown in FIG. 1.
Figure 3:
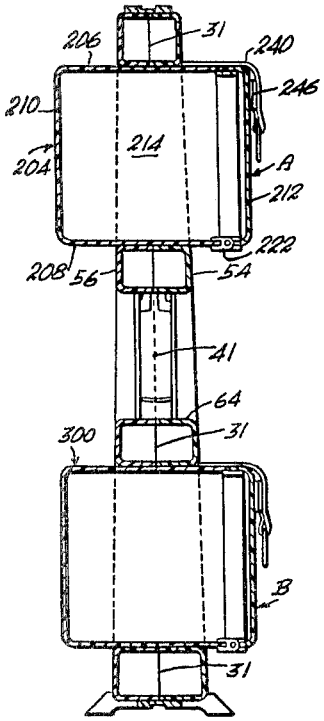
FIG. 3 is a view in cross section taken on the plane indicated by the line 3—3 of FIG. 1.
Figure 4:
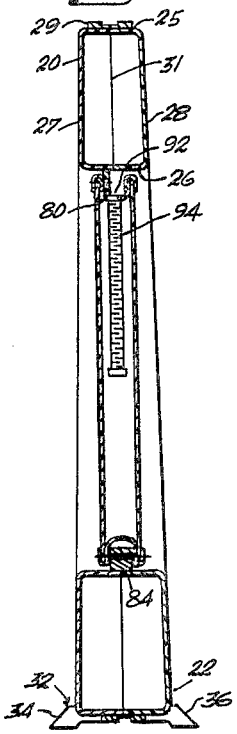
FIG. 4 is a view in cross section taken along the plane indicated by the line 4—4 of FIG. 1 and looking in the direction of the arrows.

Referring to the drawings wherein like reference characters designate like or corresponding parts throughout the several views, and referring particularly to FIG. 1, there is shown a racquet carrying and display frame or case generally designated by the numeral 12. It includes a frame ring of interconnected or interjoined runs, an end run 16, an opposite end run 18, and an upper run 20 and a lower run 22. In the embodiment illustrated, see FIG. 4, these runs are shown as being hollow or tubular with outer, inner and side surfaces 25, 26, 27 and 28; however, the same may be solid. Additionally, as shown, a peripheral decorative band 29 may be provided which also serves to maintain mating ring run parts together along a line of abutment and of juncture 31; however, any type of run structure may be utilized in defining the frame ring. Generally speaking, in the preferred embodiment, the skeletal ring or frame construction utilized is of rigid plastic material and is provided with a pair of support feet generally designated by the numerals 32 and 33. In FIG. 4 it is seen that the supports diverge defining two outwardly-extending feet portions or legs 34 and 36 to provide stability. In the embodiment shown a slim line design is illustrated, that is, the upper run side surfaces diverge downwardly with respect to one another as do the side surfaces of the lower run 22. Alternatively, the cross-sectional area of the runs of the ring may be of common size. In any event, it is seen that a carrying and display case or ring is provided, and the overall length of the carrying case, that is, the distance between the frame end runs is slightly greater than the overall length of the racquet, but not sufficiently great so as to permit tilting of the racquet from the position shown in the drawings to an askew position. Further, the distance between the upper and lower runs is slightly greater than the overall span across the head end of a racquet but not substantially greater. There is thus defined a case or frame interior which may be considered as having a main plane of symmetry which is common with respect to the runs of the frame and generally coincident with the main center plane of a racquet when positioned therein as shown in FIG. 1 and which plane may be considered to be represented by the line designated by the numeral 31 in FIG. 3. It will also be recognized that there is a longitudinally-extending centerline of the racquet shown in FIG. 1 which is generally coincident with a longitudinally-extending centerline through the frame extending through the end runs and is generally designated by the numeral 41 in FIG. 3. It may be considered that, above this line 41 there is a zone, which is designated by the letter A, adjacent the upper run and the end run 16; and a lower zone, designated by the letter B, which is adjacent the lower run 22 and the end run 16, the zones A and B being on opposite sides of the longitudinally-extending centerline 41 of the frame. Extending from the frame there is a septum with opposite main outer faces which preferably is of rigid plastic material having opposite outer faces 54 and 56. Septum as used herein means a wall generally and a dividing wall particularly with respect to the outer runs and the cutout. This may be considered to be a skin joining the runs of the frame; and it may be composed of two spaced parallel sheet pieces or it may be a single rigid sheet spanning the frame. In any event, the septum defines a cutout generally designated by the numeral 60 which includes a first portion 62 sized to receive the head end of a racquet and a second portion 64 which is elongate and extends from the first portion toward the first end run 16 of the frame and which is sized to receive the handle of the racquet. Holding means are provided on the frame to hold and orient a racquet generally as shown in FIG. 1 and designated by the numeral 70 in this cutout. The holding means in the embodiment shown include the septum extending from the frame and clamp means, such as that designated by the numerals 80, 82, 84 and 86, which extend from the septum slightly into the cutout gripping at their extending or terminal ends, a jacket generally designated by the numeral 90 which is sized to receive the head end of a racquet and includes an access opening 92 which may have a zipper closure 94 which can be opened by movement of the operator ring 96.

It is thus seen that a person using the racquet may open the zippered opening, insert the racquet and the racquet will be held in the position shown in FIG. 1 with the stem of the handle 101, which is often highly decorative, being displayed. Alternatively, although not shown, the clamps might engage the side surface of the racquet head without the use of the jacketing means 90 for a full display of the racquet.

The frame is provided with a carry handle 103 on pivot means 105 and 107 connected to the upper run 20; the handle can be rotated into the down and out-of-the-way position shown in FIG. 1, that is, in the recessed portion 109 of the top run 20.

Referring to the zone A, a compartment means generally designated by the numeral 204 is provided which, it is seen, includes an upper surface 206, a lower surface 208 and side surfaces 210 and 212 bounding a zone or chamber 214 sized to receive a tennis ball or group of tennis balls. Additionally, a hinge is provided as at 222 for pivotal movement of the side surface 212 which comprises a door and there is a keeper means 240 provided on the upper run 20 with snap means 246 for snapping engagement with the side surface 212 to hold it in the position shown in FIG. 3 for convenient access. Similarly, lower compartment means designated by the numeral 300 are provided in the zone designated by the numeral B and the structure will not be there redescribed for purposes of brevity with the exception of noting that the compartment means, either the one in zone A or zone B, or both, may be separate units suitably fixed as by adhesive means or other means to the frame or the septum which extends from the frame.

Figure 5:
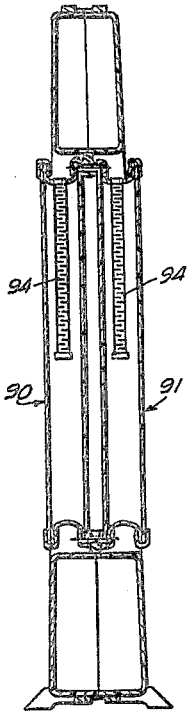
FIG. 5 is a view similar to that shown in FIG. 4 and illustrating an alternative embodiment of the instant invention wherein two racquets are housed in the carrying case.

As shown in FIG. 5, the device is adapted to have two jackets 90 and 91 in close, side-by-side relation adapting the case for carrying two racquets simultaneously and displaying the same conveniently, if desired.

While the structure shown in the drawings is shown in a preferred embodiment, it is recognized that departures may be made therefrom within the scope of the overall concept of utilizing an open sided frame to protectively ring a racquet, which frame has a geometrical configuration that, as seen in side elevation circumscribes the tennis racquet by an upper and lower line which are parallel and end lines and wherein the zones on the opposite sides of the handle of a racquet held and displayed in the frame are utilized as compartments for balls or other play-related items and there is thus defined a three compartment unit, each of which compartment may be opened as desired by use of the zipper or other type fastener means and the racquet and tennis equipment are adapted to be easily transported and conveniently utilized.

What is claimed is:

1. A racquet case for carrying, displaying and storing a racquet of a predetermined overall length, the racquet having a handle of a predetermined cross sectional area and a head end of a predetermined thickness and span, said case comprising:

a rigid frame defining a center opening, the rigid frame including an upper and lower run in spaced parallel relation and of a length substantially equal to but slightly greater than that of the overall length of the racquet, and said frame including a first and second end run in spaced parallel relation with respect to one another and extending between said upper and lower runs, and said upper and lower runs being spaced from one another a distance substantially equal to, but slightly greater than the span of the head end of the racquet, and each of said runs having an outer and an inner surface and spaced side surfaces extending from the outer surface and said side surfaces of each run being equispaced from one another defining a medial main plane of symmetry of said frame, means for holding the racquet in confining relation to the center opening extending from the frame to hold the racquet between the runs with the main plane of the racquet oriented generally coincident with the plane of symmetry, with the handle generally parallel to the upper and lower runs, and the head end adjacent the second end run, and compartment means including access means for opening and closing said compartment means carried by the frame and extending along the racquet handle.

2. The device as set forth in claim 1 wherein means for holding the racquet in confining relation to the center opening comprise:

the runs defining a cutout of a predetermined size generally in the shape similar to, but slightly larger than, a racquet to be carried and displayed in the frame, said cutout having a first portion closely adjacent the upper, lower and second runs, the first portion being sized to receive the head of the racquet and the cutout having a second elongate portion extending from the first end run to the second end portion sized to receive the racquet handle.

3. The device as set forth in claim 2 wherein the holding means includes means on the inner surface of the runs for engaging the racquet and holding the racquet in confining relation to the center opening.

4. The device as set forth in claim 3 wherein said holding means comprises the runs defining the cutout such that the outer inner and spaced side surfaces form a cutout of a predetermined size and shape which engages the racquet head and handle and holds the racquet in confining relation to the center opening.

5. The device as set forth in claim 3 comprising said skin means is of rigid plastic sheet form material bounding said cutout.

6. The device as set forth in claim 3 wherein said holding means includes a jacket sized to receive the head end of the racquet and access means for inserting the head end into the jacket means.

7. The device as set forth in claim 6 wherein zipper means are provided for opening and closing the access means of said jacket.

8. The device as set forth in claim 3 wherein support means including diverging feet are provided on the lower run and extending outwardly with respect to the side surfaces of said lower run.

9. The device as set forth in claim 3 wherein said holding means is arranged to hold a first and second racquet in closely adjacent, parallel, commonly-oriented positions with respect to said medial main plane of symmetry of said frame.

10. The device as set forth in claim 3 wherein said compartment means comprise a first and second compartment, said first compartment being an elongate compartment adjacent said upper run and said second compartment is adjacent said lower run and said second compartment is sized to receive a plurality of tennis balls therein, said compartment means being symmetrical with respect to said plane of symmetry of said frame.

11. A frame for use in carrying and displaying a racquet of predetermined size and shape and being of a predetermined maximum thickness, said frame comprising:

a top surface and a bottom surface spaced from one another and end surfaces interconnecting the top and bottom surfaces, the end surfaces being spaced from one another a distance substantially equal to the overall length of the racquet, a main septum spanning the top, bottom and end surfaces of the frame, the main septum defines a central cutout zone between the top, bottom and end surfaces, the cutout zone being sized and configured to nestle the racquet bounded by the top, bottom and end surfaces with the handle oriented parallel to the bottom surface, means for releasably engaging the tennis racquet and holding the tennis racquet in the cutout, the means carried on the main septum adjacent the cutout, compartment means carried on the main septum between the top, bottom and end surfaces including a first and second compartment, each of said compartments being of a width greater than the top, bottom and end surfaces and being symmetrical with respect to a common plane and said top, bottom and end surfaces being symmetrical with said plane, and each compartment including access means, and said top, bottom and end surfaces protectively housing said racquet.

12. The device as set forth in claim 11 wherein said septum means comprises rigid plastic material extending from said top, bottom and end surfaces.

13. The device as set forth in claim 11 wherein band means are provided about said top, bottom and end surfaces.

14. The device as set forth in claim 11 wherein said top surface includes a recess intermediate said end surfaces and handle means are provided in spanning relation of said recess and pivot means are provided mounting said handle means to said frame.

15. The device as set forth in claim 11 wherein said means carried on the septum means to releasably engage the tennis racquet comprise a jacket sized to receive the head end of the racquet and access means for insertion of the racquet into said jacket means and closure means for closing said access means.

* * * * *